US006695060B1

(12) United States Patent
Guidry, Jr. et al.

(10) Patent No.: US 6,695,060 B1
(45) Date of Patent: Feb. 24, 2004

(54) DOWNHOLE PUMPING SYSTEM

(76) Inventors: Michael J. Guidry, Jr., 23186 Nichols Saw Mill Rd., Hockley, TX (US) 77447; William D. Murray, 17307 Holsberry Ct., Tomball, TX (US) 77377

( * ) Notice: Subject to any disclaimer, the term of this patent is extended or adjusted under 35 U.S.C. 154(b) by 4 days.

(21) Appl. No.: 10/246,981

(22) Filed: Sep. 19, 2002

(51) Int. Cl.[7] ..... E21B 43/00

(52) U.S. Cl. ..... 166/370; 166/68.5; 166/105; 417/360; 417/450

(58) Field of Search ..... 166/369, 370, 166/68, 68.5, 105; 417/360, 450

(56) References Cited

U.S. PATENT DOCUMENTS 2,501,237 A * 3/1950 Sanders ..... 166/105.3
2,943,683 A * 7/1960 Dirksen ..... 166/106
3,372,756 A * 3/1968 Muckleroy ..... 166/206
3,414,057 A * 12/1968 Harbison ..... 166/105
4,363,359 A * 12/1982 Taylor et al. ..... 166/214
4,440,221 A * 4/1984 Taylor et al. ..... 166/106
4,625,798 A * 12/1986 Bayh, III ..... 166/106
4,957,161 A * 9/1990 Cholet et al. ..... 166/105
5,005,651 A 4/1991 Burrows
5,361,834 A * 11/1994 Cox ..... 166/120
5,636,689 A 6/1997 Rubbo et al.
5,746,582 A 5/1998 Patterson
5,871,051 A * 2/1999 Mann ..... 166/377
5,988,992 A * 11/1999 Tetzlaff et al. ..... 417/360
6,089,832 A 7/2000 Patterson

* cited by examiner

*Primary Examiner*—Hoang Dang

(57) ABSTRACT

A downhole pump system allows fluid to be pumped from a well to the surface through a production tubing string, while also allowing the downhole pump 10 to be retrieved to the surface while the production tubing string remains in the well. The downhole pump may include a hold down housing 12, a mandrel 14, a drive coupling 18, and a lifting nut 20. The pump is driven by a drive rod, which conventionally extends from the surface to the downhole pump. Axial movement of pump components may be prevented by a spring lock mechanism 24, while torque transmitting surfaces 26 prevent rotation of the pump housing 12 with respect to a landing nipple 25.

22 Claims, 3 Drawing Sheets

DOWNHOLE PUMPING SYSTEM

FIELD OF THE INVENTION

The present invention relates to a downhole pumping system used to pump fluid from a well, such as a petroleum recovery well, to the surface through a production tubing string within the tubing string. More particularly, this invention relates to equipment and techniques which allow the installation and retrieval of the downhole pump without requiring the removal of the production tubing string from a well, thereby saving significant costs.

BACKGROUND OF THE INVENTION

Downhole pumps have been used for decades to pump fluids from a petroleum well to the surface. Pumps are generally classified as reciprocating pumps, wherein the drive member to the pump is a reciprocating rod within the tubing string, or progressive cavity pumps, wherein the pump is powered by a rotating rod string within the tubing string. A third type of downhole pump is an electrically powered submersible pump, and a fourth type is a jet pump. The electrically powered pump and the jet pump do not transmit a pumping force downhole on a rod string to power the pump.

It is periodically necessary to retrieve the downhole pump to a surface for inspection and/or repair. In many situations, this requires the retrieval of the pump with the production tubing string, which may be thousands of feet in length. The operation of running the tubing string and downhole pump from the well and thereafter running the tubing string and the repaired pump back in the well may cost thousands of dollars. Moreover, hydrocarbon production may be adversely affected by the tubular breakout and subsequent run in operation, including damage to the pipe or other casing surrounding the tubing string, and/or damage to the tubing string or the repaired pump. In some operations, the process of repairing the pump involves both the time and expense associated with recovering the tubing string, and thereafter patching or repairing the casing string before the repaired pump and tubing string are run back into the well.

Various mechanisms have been suggested for allowing the retrieval of a downhole pump without requiring the retrieval of the tubing string. U.S. Pat. No. 5,005,651 discloses a hold-down mechanism for selectively holding a pump in place on the tubing string, but also for releasing the pump so the pump can be retrieved while the tubing string remains in the well. More particularly, the tubing string is lowered to unseat the hold-down from a seating nipple, so that an upward force is applied on an adapter. U.S. Pat. No. 5,636,689 disclose a technique for retrieving a downhole tool while preventing premature actuation of the tool during insertion into a well. During retrieval, a pin is released from a slot, allowing the collapse of a C-ring to a reduced diameter, so that a lower cone pulls away from a mandrel. U.S. Pat. No. 5,746,582 also discloses a pump for lifting formation fluids to the surface while allowing the pump to be retrieved through the production tubing. The pump is retrievably positioned within the production tubing string and is releasably connected to a downhole motor which is driven by electrical power. To release the pump, the polarity of current to the motor is reversed. U.S. Pat. No. 6,089,832 discloses another downhole pump intended to be retrieved and reinstalled through the production tubing string while leaving the tubing string in place in the well. To retrieve the pump, one member moves upward to engage a seat, which equalizes pressure to reduce the upward force required to unlatch the pump.

Many of the techniques for allowing retrieval of a pump while leaving the tubing in place are complex and thus costly, and also require components which have a relatively short life. Improved techniques are required for obtaining the advantages of a downhole pump which can be retrieved to the surface through the production tubing string. The disadvantages of the prior art are overcome by the present invention, and an improved downhole pump system and technique for installing and retrieving the downhole pump are hereinafter disclosed.

SUMMARY OF THE INVENTION

The downhole pump system according to the present invention comprises a pump housing, a mandrel movable relative to the pump housing to pump fluid, a drive rod, a drive coupling and a lifting nut. The drive rod may be connected to the pump for either rotating or reciprocating the mandrel relative to the pump housing, thereby pumping fluid to the surface. The pump may be inserted into a production tubing and pushed along the production tubing by the drive rod.

Axial movement of the pump with the drive rod for a progressive cavity pump may be provided by the drive rod being attached to the rotor by a drive coupling. Thrust may be applied when pushing by the end of the rotor contacting the mandrel. When lowering or pulling the pump, tension may be applied by the drive coupling contacting the lifting nut.

The pump may be secured in the casing by engaging the in the pump housing with a landing nipple positioned along a lower end of the production tubing string, with the landing nipple including a locking groove. Axial movement of the pump housing may be restricted by a spring lock mechanism, which preferably is a radially expandable and collapsible C-ring. Rotation of the pump housing may be prevented by the use of a spine, key, or similar rotation limiting surfaces on the pump housing and the landing nipple. Fluid leakage and/or solids migration may be prevented by the combination of fluid and debris seals.

It is a feature of the present invention that radial seals are provided at the upper end of the housing, and may include brush, elastomeric, energized, deformable, non-contact, packing, and grease type seals. A related feature of the invention is that compression seals are provided at the lower end of the housing. Again, these seals may include brush, elastomeric, energized, deformable, non-contract, packing, and grease type seals. A reduced radius annular seal is also preferably provided at the lower end of the housing, and may be any of the type of seals discussed above. Each of the seals preferably has a diameter less than an inner nominal diameter of the production tubing string, thereby minimizing wear on the seals and the tubing when running the pump into and out of the interior of the production tubing string.

The pump may include a reduced diameter leading edge for inserting the pump into the pipe or other casing, and for engagement of the pump housing into the landing nipple. A spring and groove system, preferably having a C-ring carried on the landing nipple for engagement with an external groove in the pump housing, may be used to restrict axial movement of the pump housing. The spring may be a ring, leaf, Belleville, coil or torsion type spring, and may be provided with or without a latching mechanism mounted with the spring, so that a latch rather than the spring engages the external groove in the pump housing. The spring may be fixed or floating, and cooperates with the groove to limit axial movement of the pump housing.

These and further objects, features, and advantages of the present invention will become apparent from the following detailed description, wherein reference is made to the figures in the accompanying drawings.

DESCRIPTION OF THE PREFERRED EMBODIMENTS

Figure 1:
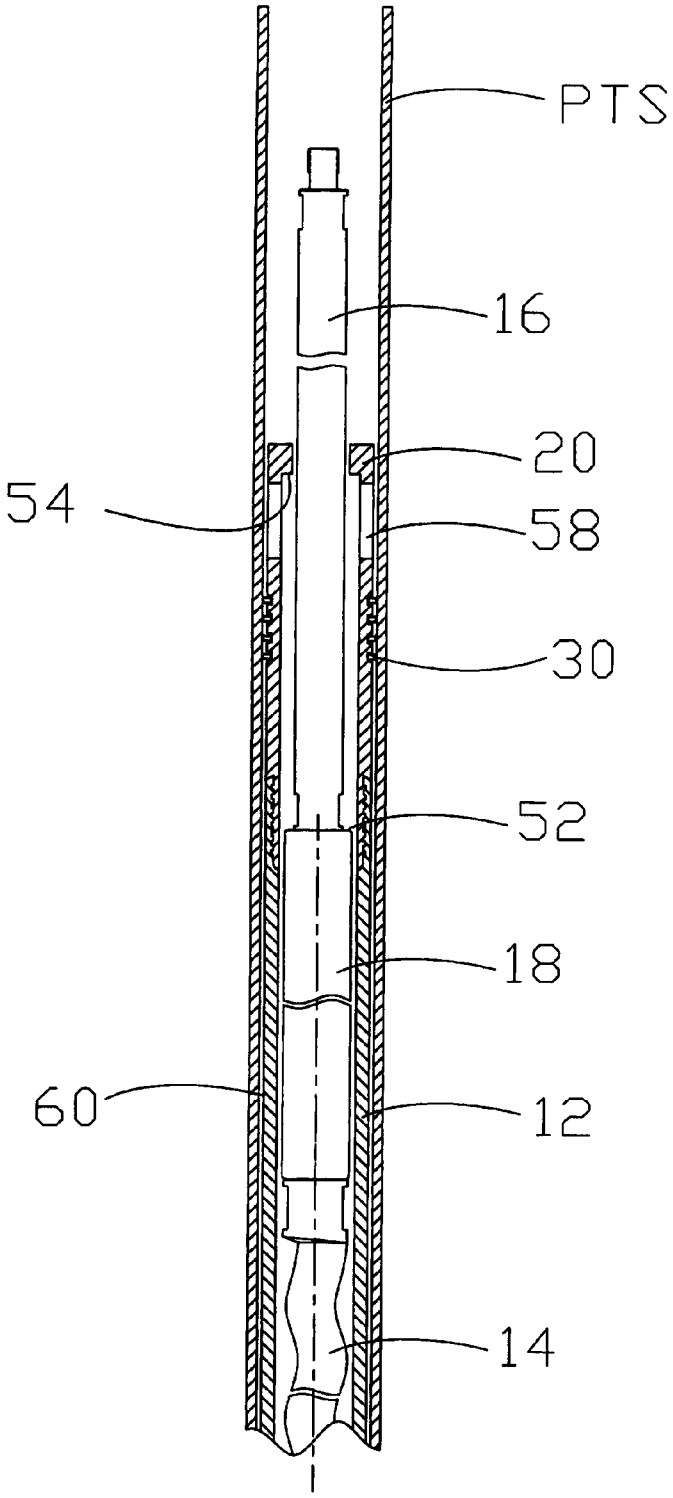
FIG. 1 generally illustrates an upper portion of pump rotor suspended in a well from a rod string, with the pump housing positioned above a landing nipple at a lower end of a production tubing string.

The primary component of the downhole pump system include pump 10 as shown in FIG. 1 having a hold-down housing 12 and a mandrel 14, which may be a progressive cavity rotor, a drive coupling 18, and lifting nut 20, which is shown at the upper end of the housing 12. For a progressive cavity pump, the housing 12 and the inner rubber layer secured thereto is referred to as a stator. The pump is installed and withdrawn from the tubing string by using a drive rod 16, which may be conventional lengths of sucker rods. The drive rod also powers the pump, and accordingly for a progressive cavity pump the drive rod rotates within the production tubing string while pumping fluid, while for a reciprocating pump the drive rod moves axially within the production tubing string. A tubing rotator may thus be used to rotate the drive rod 16, and a conventional pump jack may be used to reciprocate the rod string.

The drive rod 16 is attached to the rotor 14 via a drive coupling 18. Thrust is applied when pushing by the end of the rotor contacting the mandrel stop 23 (see FIG. 2) secured to the pump housing 12, thereby lowering the pump in the well. When pulling the pump from the well, a tension load is applied by the drive coupling 18 contacting the lifting nut 20, as discussed subsequently.

Figure 2:
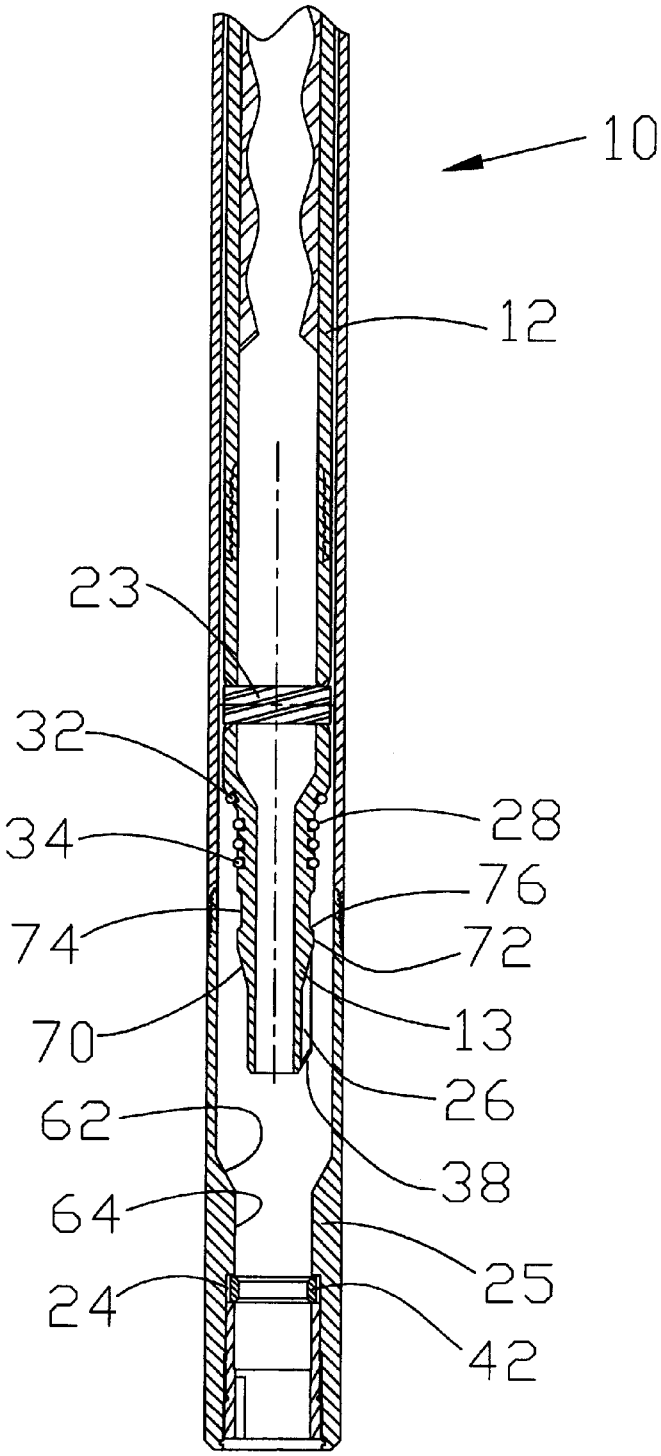
FIG. 2 generally illustrates a lower portion of the pump housing and the landing nipple.
Figure 3:
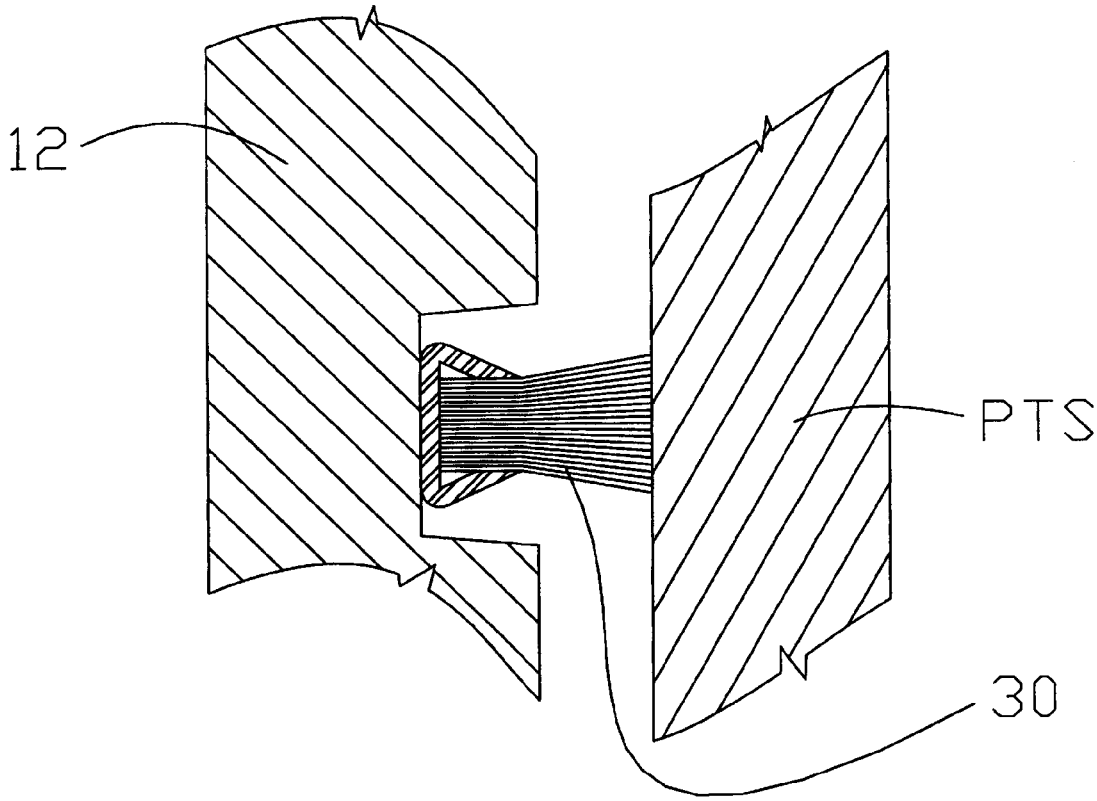
FIG. 3 illustrates in greater detail the brush seals at the upper end of the pump housing.

The pump is secured in the production tubing string by engaging the housing 12 with the landing nipple 25. Axial movement is restricted by a spring lock mechanism 24, as shown in FIG. 2. A spine, key or similar rotation limiting surfaces 26 may be provided on the housing 12 and the landing nipple 25 for preventing rotation of the pump housing with respect to the production tubing string PTS. Leakage of fluids may be prevented by the combination of lower and upper fluid and debris seals 28, 30, respectively.

Radial seals 30 are provided at the upper end of the housing 12 for engagement with the cylindrical bore wall of the production tubing, and may include brush, elastomeric, energized, deformable, non-contact, packing and grease type seals. Seals 28 may be provided at the lower end of the housing 12, and may include one or more compression seals 32 and/or one or more radial seals 34. The upper seals may be referred to as brush or debris seals, which do not hydraulically seal, but do act to keep debris from passing by the seal. The seals 28 do provide a hydraulic seal with the landing nipple, and preferably have an outer diameter substantially less, e.g., 90% or less, than a nominal diameter of the production tubing string PTS as shown in FIG. 1, and may be of the type discussed above (except a brush seal). The cylindrical bore wall 60 of the landing nipple has a diameter less than an inner diameter of the production tubing string PTS as shown in FIG. 1, so that when running in or pulling the pump from the well, the seals 30 ideally do not engage the interior surface of the production tubing string, although contact with the production tubing string PTS is likely. Seals 28 at the lower end of the housing 12 seal against the seal surfaces 62 and 64 of the landing nipple 25, and each of these seals has a significantly reduced diameter compared to the inner diameter of the production tubing string. The seals 28 thus do not engage the production tubing string PTS when running the pump into and out of a well.

A reduced diameter leading edge 38 is provided to facilitate insertion of the pump housing into the production tubing string and into the landing nipple 25. Thus, the lower end 13 of the pump housing 12 preferably has a significantly reduced diameter compared to the diameter of the housing which, when pumping fluid, houses the rotating or reciprocating mandrel 14. Spines, keys, pins, mating upsets or similar rotation limiting surfaces 26 restrict rotation of pump components. A spring and groove mechanism 24 may be used to restrict axial movement at the pump housing with respect to the landing nipple 25, which is secured to a lower end of the production tubing string PTS. The spring 42 is preferably a C-ring, but alternatively may be a ring, leaf, Belleville, or coil type spring, and may be provided with or without a latching mechanism. For a preferred embodiment as shown in FIG. 2, spring 42 is first engaged by tapered surface 70 on the pump housing, which radially expands the ring 42 past a large diameter portion 72 on the pump housing, so that the ring returns to its contracted position within the groove 74 on the pump housing, thereby interconnecting the pump housing with the downhole nipple. In order to retrieve the pump from the well, a substantial upward pull is applied to the drive rod 16. The higher angle camming surface 76 on the pump housing then radially expands the C-ring past the enlarged portion 72, thereby releasing the pump housing from the landing nipple. For this embodiment, spring 42 functions both as the biasing member and the latch member. Significant advantages are obtained by carrying the latch member on the landing nipple rather than on the pump housing. Alternative embodiments may include other forms of biasing members and, for some of these biasing members, it would likely be preferable to provide a radially movable latch member which moved within a slot (or groove) in the pump housing, so that the latch member secured the pump housing to the landing nipple, and was moved from a latch position to a release position by overcoming the biasing member. C-ring 42 has a significant advantage since, when the C-ring connects the pump housing to the landing nipple, and when the pump is being run in or run out of the production tubing string, the C-ring is in its relaxed condition, which for the embodiment shown is its contracted position. High stresses on the C-ring are thus minimizes, since the only time the C-ring is expanded or stressed is during its operation of latching or unlatching the pump housing to the downhole nipple. The C-ring may be carried on either the landing nipple or the pump housing, but is preferably on the landing nipple for large size pumps. The C-ring radially moves to engage or disengage a stop surface, which may be an annular groove on the member not carrying the C-ring.

A C-ring also has advantages since a single unitary member functions as both the biasing member and the latch. Various types of materials may be used to fabricate the C-ring. Depending on the application, the C-ring may be formed from titanium, a copper beryllium mixture, or steel.

The spring 42 may be fixed or floating, and cooperates with the groove 44 to limit axial movement of pump components. The C-ring as shown in FIG. 2 is floating so that it is allowed to freely move within its retaining groove in the landing nipple. In another embodiment, the C-ring could be fixed at a location to the landing nipple, while still allowing for radial expansion and contraction of the C-ring. In a preferred embodiment, the C-ring or latch engages a groove within the pump housing, although various types of recesses other than a groove in the pump housing may be used to receive the latch. In a less preferred embodiment, the C-ring or other latching member may be carried on the pump housing for engaging a groove or other recess in the landing nipple.

In operation, the pump 10 may be lowered or lifted into the production tubing string PTS by the drive rod 16. The drive coupling 18 may be connected to the drive rod by API threads. When pulling the pump, an upper shoulder 52 on the drive coupling 18 contacts the inner shoulder 54 at the lower end of the lifting nut 20. In a preferred embodiment, the lifting member which is engaged by the coupling 18 during retrieval of the pump from the production tubing string is a nut 20, which may be threaded to the upper end of the housing 12 for engagement with the shoulder 52 when retrieving the pump. When the pump is retrieved to the surface, the nut 20 may then be unthreaded from the housing pull the mandrel from the pump housing. Various other types of lifting members may be used for engagement with the mandrel, and inherently a modified structure for lifting the pump from the well will be provided for a system with a reciprocating pump.

Exit flow of fluid from the pump is afforded by two channels. Flow is allowed through the clearance between the drive rod 16 and the lifting nut 20, and flow is also allowed between the pump housing and the production tubing via ports 58 in the pump housing. Debris may be kept out of the annular space between the pump and the production tubing by seals 28, 30 discussed above.

Pump housing 12 is anchored to the landing nipple 25 by first thrusting the rotor 22 through the stator, which for a progressive cavity pump is the housing 12, until it contacts the stop 23 located on the housing 12. Additional thrust is applied until the spring 42 held in a gland or groove in the landing nipple 25 engages the mating groove 74 in the pump housing 12. Resistance to rotating may be afforded by keys 26 acting between the landing nipple 25 and the housing 12. Rotating of the pump housing initially may be allowed until contact is made between the keys 26, whereupon further rotation is prevented. A fluid seal between the pump housing and the production tubing string may be provided by seals 32 engaging a tapered sealing surface 62 on the inside of the landing nipple 25, and optionally also by seals 30 engaging a cylindrical surface of the landing nipple, as discussed above.

The term "pump housing" as used herein is broadly intended to refer to any housing for a pump which houses a mandrel which moves relative to the pump housing to pump fluid. In many applications, the mandrel moves relative to the stationary pump housing to pump fluid. In other applications, the pump housing moves relative to the stationary mandrel. The lower end of the housing shown herein has a significantly reduced diameter to fit within the landing nipple. The lower end of the pump housing can be fabricated as a separate component from the upper end of the pump housing. These components are nevertheless interconnected, and as disclosed herein the lower end of the pump housing which fits within the landing nipple and has the groove for receiving the C-ring is considered part of the pump housing. Similarly, the term "mandrel" is broadly intended to refer to any member which rotates or reciprocates with respect to the pump housing. The term "drive coupling" is broadly intended to refer to any member which interconnects the drive rod to drive the pump. A threaded nut as disclosed herein is one form of lifting member for engagement with the mandrel to retrieve the pump from the well when the C-ring or latch is disengaged from the locking groove. Various structures for the lifting mechanism will be apparent to those skilled in the art. The term "landing nipple" is intended in its broad sense to be a fluid transmission member (or nipple) inline with the production tubing string, with the nipple being configured for supporting (or landing) a pump thereon.

While preferred embodiments of the present invention have been discussed in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A system for pumping fluid from a downhole well to the surface through a production tubing string using a downhole pump which may be retrieved without removing the production tubing string from the well, the system comprising:

a landing nipple positioned at a lower end of the production tubing string;

a drive rod extending from the surface downhole for powering the downhole pump;

the downhole pump including a pump housing with a locking groove on the pump housing;

a mandrel moveable relative to the pump housing to pump fluid;

a C-ring carried on the landing nipple for positioning within the locking groove on the pump housing to axially connect the pump housing to the landing nipple;

a drive coupling for interconnecting the drive rod with one of the pump housing and the mandrel; and a lifting member supported on the pump housing for engagement with the mandrel to retrieve the pump from the well when the C-ring is disengaged from the locking groove.

2. A system as defined in claim 1, wherein the drive rod is rotated to rotate a pump rotor with respect to a pump stator.

3. A system as defined in claim 2, wherein axial movement of the pump rotor is limited by a stop surface on the pump stator when running the pump into a well.

4. A system as defined in claim 1, wherein the drive rod reciprocates in the well to power to the downhole pump.

5. A system as defined in claim 1, wherein the lifting member is a nut threaded to the pump housing.

6. A system as defined in claim 1, wherein rotational movement of the pump housing is restricted by torque limiting surfaces on the landing nipple.

7. A system as defined in claim 1, further comprising:

one or more upper seals at an upper end of the pump housing for limiting debris passing below the upper seals; and one or more lower seals at a lower end of the pump housing for sealing with the landing nipple.

8. A system as defined in claim 7, wherein the one or more lower seals seal against an internal surface of the landing nipple having a diameter substantially less than a nominal diameter of the production tubing string.

9. A system for pumping fluid from a downhole well to the surface through a production tubing string using a downhole pump which may be retrieved without removing the production tubing string from the well, the system comprising:

a landing nipple positioned at a lower end of the production tubing string;

a drive rod extending from the surface downhole for powering the downhole pump;

the downhole pump including the pump housing with a locking recess on one of the pump housing and the landing nipple;

a mandrel moveable relative to the pump housing to pump fluid;

a biased latch carried on the other of the pump housing and the landing nipple to engage the locking recess to axially connect the pump housing to the landing nipple;

a drive coupling for interconnecting the drive rod with one of the pump housing and the mandrel;

a lifting member supported on the pump housing for engagement with the mandrel to retrieve the pump from the well when the latch is disengaged from the recess;

one or more upper seals at an upper end of the pump housing for limiting debris passing below the upper seals;

one or more lower seals at a lower end of the pump housing for sealing with the landing nipple; and each of the lower seals for sealing with the landing nipple has a diameter substantially less than a nominal diameter of the production tubing string.

10. A system as defined in claim 9, wherein the drive rod is rotated to rotate a pump rotor with respect to a pump stator.

11. A system as defined in claim 9, wherein the lifting member is a nut threaded to the pump housing.

12. A system as defined in claim 9, wherein rotational movement of the pump housing is restricted by torque limiting surfaces on the landing nipple.

13. A system as defined in claim 9, wherein the drive rod reciprocates in the well to power to the downhole pump.

14. A method of pumping fluid from a downhole well to the surface through a production tubing string using a downhole pump which may be retrieved without removing the production tubing string from the well, the method comprising:

positioning a landing nipple at a lower end of the production tubing string;

extending a drive rod from the surface downhole for powering the downhole pump;

providing the downhole pump with a pump housing having a locking groove on the pump housing;

providing a mandrel moveable relative to the pump housing to pump fluid;

carrying a C-ring on the landing nipple for positioning within the locking groove on the pump housing to axially connect the pump housing to the landing nipple;

interconnecting the drive rod with one of the pump housing and the mandrel with a drive coupling; and supporting a lifting member on the pump housing for engagement with the mandrel to retrieve the pump from the well when the C-ring is disengaged from the locking groove.

15. A method as defined in claim 14, further comprising:

rotating the drive rod to rotate a pump rotor with respect to a pump stator.

16. A method as defined in claim 14, further comprising:

reciprocating the drive rod in the well to power to the downhole pump.

17. A method as defined in claim 14, further comprising:

engaging the drive coupling with the lifting member when pulling the pump from the well.

18. A method as defined in claim 14, further comprising:

limiting rotational movement of the pump housing by torque limiting surfaces on the landing nipple.

19. A method as defined in claim 15, further comprising:

providing one or more lower seals at a lower end of the pump housing for sealing with the landing nipple.

20. A method as defined in claim 19, wherein each of the one or more lower seals seal against an internal surface of the landing nipple having a diameter substantially less than a nominal diameter of the production tubing string.

21. A method as defined in claim 19, further comprising:

providing one or more upper seals for engagement with an internal surface of the landing nipple to keep debris from passing below the upper seals.

22. A method as defined in claim 21, wherein the one or more upper seals includes a plurality of axially spaced brush seal rings.

* * * * *